United States Patent [19]

Hada et al.

[11] Patent Number: 4,510,209

[45] Date of Patent: Apr. 9, 1985

[54] TWO LAYER-COATED STEEL MATERIALS AND PROCESS FOR PRODUCING THE SAME

[75] Inventors: Takashi Hada; Tatsuya Kanamaru, both of Tokai; Yutaka Ogawa, Nagoya, all of Japan

[73] Assignee: Nippon Steel Corporation, Tokyo, Japan

[21] Appl. No.: 300,974

[22] Filed: Sep. 9, 1981

[30] Foreign Application Priority Data

Sep. 12, 1980 [JP] Japan ..... 55-126013

[51] Int. Cl.[3] ..... B32B 15/01

[52] U.S. Cl. ..... 428/659; 428/926; 428/935

[58] Field of Search ..... 428/658, 659, 926, 935

[56] References Cited

U.S. PATENT DOCUMENTS 3,078,555 2/1963 McFarland ..... 428/941

4,252,866 2/1981 Matsudo et al. ..... 428/659

FOREIGN PATENT DOCUMENTS 786418 11/1957 United Kingdom ..... 428/659

OTHER PUBLICATIONS

Silman, H., et al.; *Protective and Decorative Coatings for Metals,* p. 556, (1978).

*Primary Examiner*—L. Dewayne Rutledge
*Assistant Examiner*—Robert L. McDowell
*Attorney, Agent, or Firm*—Wenderoth, Lind & Ponack

[57] ABSTRACT

A two layer-coated steel material having an excellent resistance to corrosion and useful for motor vehicles, has a base coating layer formed on a surface of a steel substrate and comprising zinc or a zinc-based alloy and a surface coating layer formed on the base coating layer and comprising an iron-zinc alloy containing 40% or less of zinc.

6 Claims, 3 Drawing Figures

TWO LAYER-COATED STEEL MATERIALS AND PROCESS FOR PRODUCING THE SAME

FIELD OF THE INVENTION

The present invention relates to a two layer-coated steel material and a process for producing the same. Particularly, the present invention relates to a two layer-coated steel material which exhibits an excellent resistance to corrosion and an adaptability to a zinc-iron phosphate treatment and to other under coating procedures suitable for cationic electrodeposition coating, and a process for producing the same. More particularly, the present invention relates to a two layer-coated corrosion-resistant steel material which may be in the form of a strip, a sheet, a pipe, a tube or a die steel, which exhibits a superior resistance to rusting and which is useful as a steel material for motor vehicles, and a process for producing the same.

BACKGROUND OF THE INVENTION

It is known that a plated zinc or zinc-based alloy layer on a steel substrate exhibits an excellent galvanic protecting activity for the steel substrate. Also, it is known that the plated zinc or zinc-based alloy layer is effective for forming a passive state film on a surface of the plated zinc layer in a corrosive environment so as to protect the steel material from corrosion. Therefore, the zinc- or zinc-based alloy-plated steel materials are widely useful as corrosion-resistant materials in the field of motor vehicles, home electrical appliances and building and construction materials.

In recent years, especially, in the field of the motor vehicle industry, a cationic electrodeposition method became widely utilized for the primer coating process of steel materials. However, in this process, it was found that the cationic electrodeposition method applied to the conventional zinc- or zinc-based alloy-plated steel material caused the following disadvantages. That is, the cationic electrodeposition procedure results in formation of undesirable protuberances having a size of about 0.3 to about 2 mm or pin holes in the resultant coating layer. The protuberances and pin holes serve as starting points of locally rusting the steel substrate and result in defects in appearance which cannot be removed by means of upper-coating. This phenomenon will be explained in detail hereinafter by referring to FIG. 1 of the accompanying drawing.

According to the results of research conducted by the inventors of the present invention, it was found that the protuberances each contain therein pores. It was assumed that the pores were formed by hydrogen gas which was generated in the form of bubbles during the electrodeposition procedure. That is, in the electrodeposition procedure, cationic lacquer particles deposit on the surface of the steel material and also, water which is used as a medium, is electrolyzed to generate hydrogen gas bubbles. Sometimes, the hydrogen gas bubbles are generated below the lacquer coating layer so as to form the protuberances and/or pin holes on and/or in the lacquer coating layer. The inventors of the present invention studied the adaptability of various types of metals and alloys to the cationic electrodeposition method and found that the above-mentioned defects on and/or in the lacquer coating were created significantly when the cationic electrodeposition procedure was applied to zinc- or zinc-based alloy-plated steel materials.

Accordingly, it is strongly desired to provide a new type of zinc- or zinc-based alloy-plate steel material which does not cause the undesirable protuberances and/or pin holes to be formed on or in the lacquer coating even when the cationic electrodeposition procedure is applied thereto.

Further, it is known that in order to increase the rust-preventing effect on the lacquer coating, it is necessary to enhance the bonding property of the lacquer coating to the surface of the steel material in a corrosive environment. This necessity is attained by applying a phosphate treatment to the surface of the steel material.

For example, in the lacquer coating of a car body, the cationic electrodeposition coating method is widely distributed as stated above. This is due to the fact that when the lacquer coating formed by the cationic electrodeposition method is placed in a corrosive environment, and a local cell is formed on the coating film, the coating film in the cathode portion of the resultant local cell exhibits an excellent resistance to creep. However, the conventional zinc phosphate treatment is not adequate for forming a base coating film for the lacquer coating layer formed by the cationic electrodeposition method. When the conventional zinc phosphate treatment is applied onto the steel material, the resultant phosphate coating film mainly comprises a hopeite type zinc phosphate ($Zn_3(PO_4)_2.4H_2O$) in the form of needle-like crystals. This type of coating film is easily soluble in an alkaline environment. Therefore, when placed in an alkaline environment, the hopeite coating film in the cathode portion under the lacquer coating layer is dissolved so that the bond of the lacquer coating layer to the surface of the steel substrate is deteriorated. That is, even when the cationic electrodeposition lacquer coating film, which is highly resistant to corrosion, is formed on the surface of the steel material through the zinc phosphate coating film, which is effective for protecting the steel material surface from rust, the resultant lacquer coated steel material exhibits a poor resistance to rusting under the alkaline environment, because of a poor bonding of the lacquer coating to the steel material through the zinc phosphate coating.

In recent years, a zinc-iron phosphate treatment has been developed as a base coating method for steel material. In the zinc-iron phosphate treatment, the resultant coating film mainly comprises a phosphophyllite type zinc iron phosphate ($Zn_2Fe(PO_4)_2.4H_2O$) in the form of granular crystals. This type of coating film is highly resistive to an alkaline environment. Accordingly, the zinc-iron phosphate treatment is adequate and indispensable as a pre-treatment for forming a base coating layer on which the cationic electrodeposition lacquer coating layer is formed.

However, it should be noted that when the zinc-iron phosphate treatment is applied onto a zinc-plated surface of the steel material, no phosphophyllite is formed and only hopeite is formed on the zinc plated surface.

Therefore, even when the cationic electrodeposition lacquer coating film which is highly resistant to corrosion is formed on the zinc-plated steel material surface which is also resistive to corrosion, after the zinc-iron phosphate treatment is applied to the zinc-plate steel material, the resultant lacquer coated steel material exhibits an unsatisfactory resistance to rusting, due to the poor bonding of the lacquer coating film to the zinc-plated surface of the steel material under the alkaline environment. This phenomenon will be explained in detail by referring to FIG. 2 of the accompanying drawing hereinafter.

SUMMARY OF THE INVENTION

An object of the process is to provide a two layer-coated steel material which is highly adequate for a coating process comprising a zinc-iron phosphate treatment and a cationic electrodeposition lacquer coating procedure, and a process for producing the same.

The above-mentioned object can be attained by the two layer-coated steel material of the present invention which comprises a steel substrate and a two layer-coating composed of (1) a base coating layer formed on a surface of said steel substrate and comprising zinc or a zinc-based alloy and (2) a surface coating layer formed on said base coating layer and comprising an iron-zinc alloy having a content of zinc of 40% by weight or less.

The above-mentioned two layer-coated steel material can be produced by the process of the present invention which comprises the steps of forming a base coating layer comprising zinc or a zinc-based alloy on a surface of a steel substrate by means of a hot galvanizing procedure or an electroplating procedure, and, then, forming a surface coating layer comprising an iron-zinc alloy having a content of zinc of 40% by weight or less on the base coating layer, by means of an electroplating procedure or a vacuum evaporation procedure.

DETAILED DESCRIPTION OF THE INVENTION

In order to investigate an adoptability of an iron-zinc alloy coating layer to the cationic electrodeposition lacquer coating method, various types of iron-zinc alloy coating layers were formed on a steel strip surface and, then, the cationic electrodeposition lacquer coating procedure was applied onto the iron-zinc alloy coating layer. The number of defects formed on and/or in the resultant lacquer layer was counted.

Figure 1:
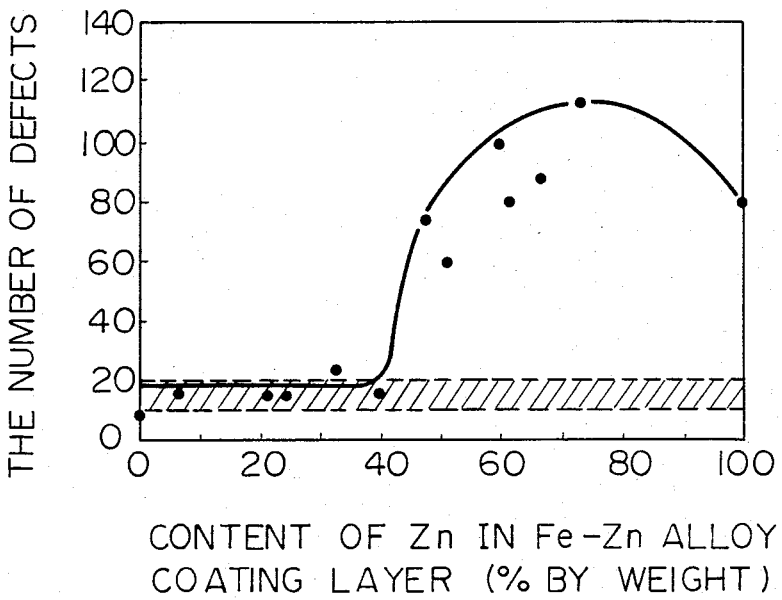
FIG. 1 is a graph showing the relationship between the content by weight of zinc in a plated iron-zinc alloy layer on a steel strip surface and the number of defects formed on and/or in the lacquer coating prepared by a cationic electrodeposition procedure.

The content of zinc in the iron-zinc alloy was varied from 0 to 100%. The cationic electrodeposition lacquer coating procedure was carried out at a voltage of 280 V, at a temperature of the electrodeposition liquid of 28° C. for 2 minutes, so as to coat 90 $cm^2$ of the surface of the steel strip, at a ratio of the coated area of the steel strip to the area of the electrode of 1/10. The relationship between the content of zinc in the iron-zinc alloy coating layer and the number of defects formed on and/or in the lacquer coating layer is indicated in FIG. 1. FIG. 1 clearly shows that when the content of zinc in the iron-zinc alloy coating layer exceeds 40% by weight, the number of the defects significantly increase. However, in the case where the content of zinc in the iron-zinc alloy coating layer is 40% by weight of less, the number of defects of the lacquer layer is in the level similar to the standard level of an ordinary cold rolled steel strip which is indicated by a hatched area in FIG. 1.

Also, it was discovered by the inventors of the present invention that as long as the content of zinc is 40% by weight or less even when the alloy contains a small amount of other metal or metals in addition to iron and zinc, the number of defects in and/or on the lacquer coating layer is as small as that on an ordinary cold rolled steel strip.

Accordingly, it is evident that the surface coating layer comprising an iron-zinc alloy containing 40% by weight or less of zinc is excellent as an under coating layer for the cationic electrodeposition lacquer layer. Also, the specific iron-zinc alloy surface coating layer of the present invention is effective for enhancing the resistance of the steel strip to corrosion and rusting.

In order to investigate the adaptability of the iron-zinc alloy coating layer to the zinc-iron phosphate treatment, a surface of a steel strip was coated by various types of iron-zinc alloys by an electroplating method, and a zinc-iron phosphate treatment was applied onto the iron-zinc alloy coating layers. Thereafter, a cationic electrodeposition lacquer coating procedure was applied to the zinc-iron phosphate-treated surface of the steel strip so as to form a lacquer coating layer having a thickness of 20 microns.

The lacquer-coated steel strip was subjected to a cross-cut test in which the cross-cut steel strip was subjected to a salt solution-spraying procedure for 500 hours. The resistance of the lacquer layer to the salt solution was represented by the largest width of blisters formed on the lacquer layer. The larger the largest width of the blisters, the lower the resistance of the lacquer layer to salt solution. The result of the above-mentioned experiment is indicated in FIG. 2.

Figure 2:
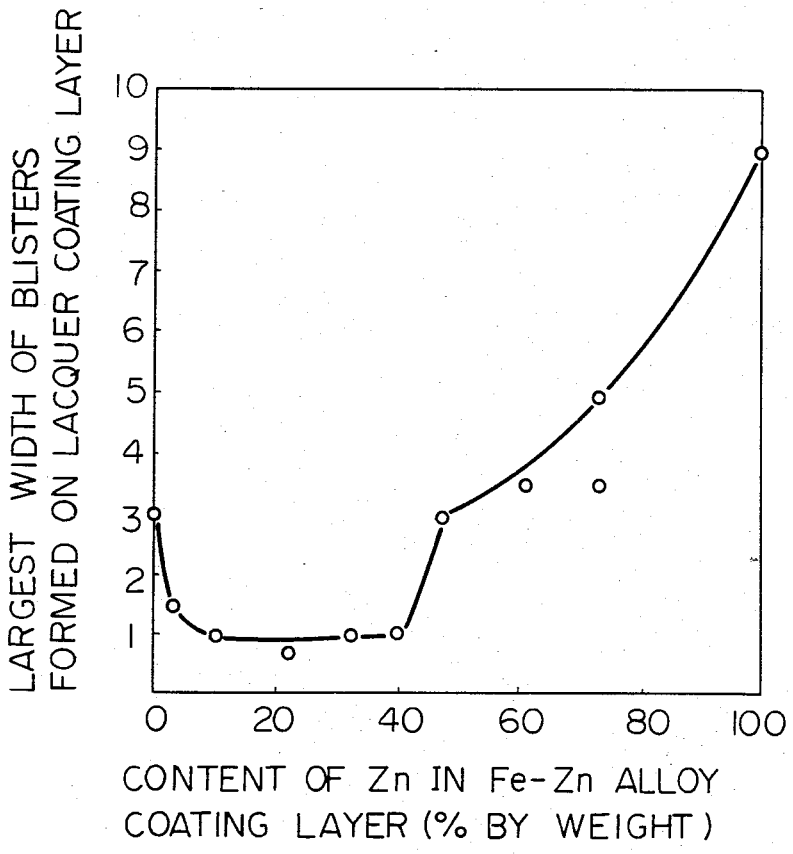
FIG. 2 is a graph showing the relationship between the content by weight of zinc is a plated iron-zinc alloy layer on a steel strip surface and the resistance of a lacquer coating layer formed on the plated iron-zinc alloy layer by a cationic electrodeposition procedure, to corrosion and rusting, the resistance is represented by the largest width in mm of blisters formed on the lacquer coating layer by a cross-cut test.

Referring to FIG. 2, it is evident that when the content of zinc in the iron-zinc alloy coating layer is 40% by weight or less, preferably, from 2 to 40% by weight, the lacquer coating layer exhibits an excellent resistance to corrosion. This phenomenon is due to the fact that when the content of zinc in the iron-zinc alloy coating layer is 40% by weight or less, that is, the content of iron in the alloy coating layer is high, the zinc-iron phosphate treatment results in the formation of phosphophyllite.

This phenomenon occurs even if the iron-zinc alloy layer contains a small amount of other metal or metals.

In order to make clear the relationship between the content of zinc in the iron-zinc alloy coating layer and the formation of the phosphophillite by the zinc-iron phosphate treatment, the covering property of the phosphate film formed on the iron-zinc alloy coating layer and the size of the resultant phosphate crystal grains were measured. The result is indicated in FIG. 3.

Figure 3:
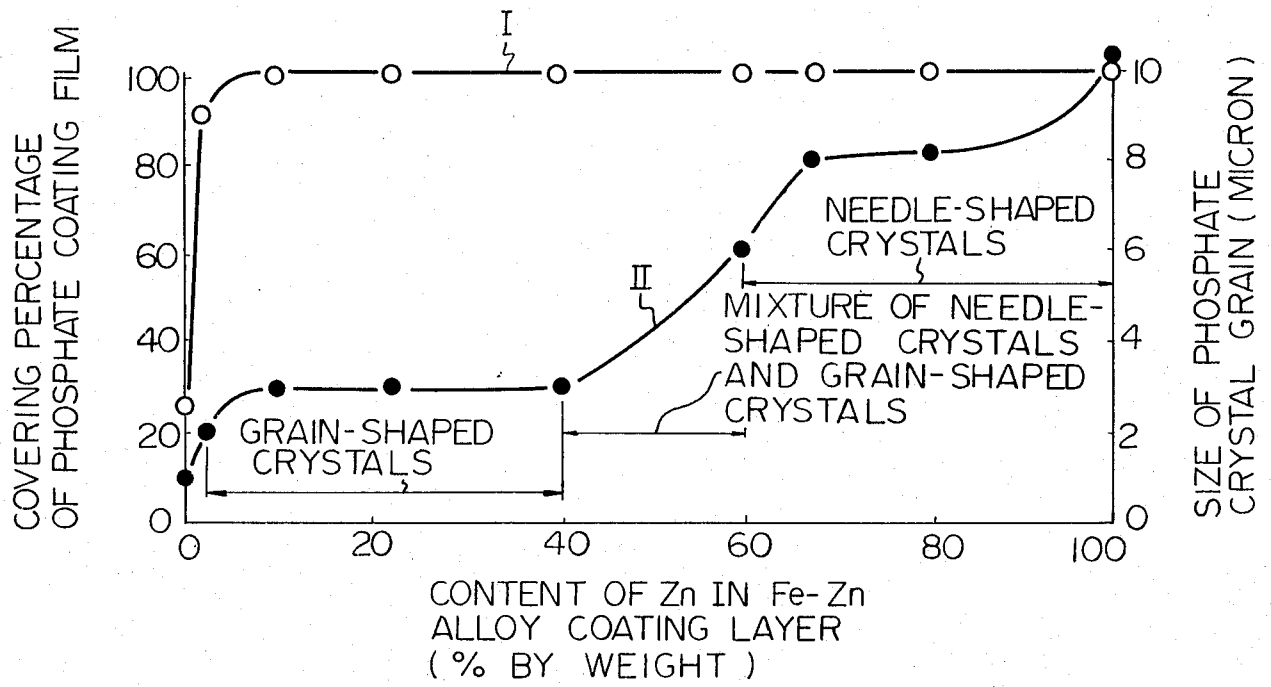
FIG. 3 is a graph showing the relationship between the content by weight of zinc in a plated iron-zinc alloy layer formed on a steel strip surface and the intensity of the covering property of a phosphate film layer on the plated iron-zinc alloy layer, and also the relationship between the content of zinc in the iron-zinc alloy coating layer and the size of phosphate crystal grains.

Referring to FIG. 3, Curve I indicates the relationship between the content of zinc and the covering percentage of the phosphate coating film, and Curve II shows the relationship between the content of zinc and the average size of the phosphate crystal grains. From Curve II, it is evident that, when the content of zinc is 40% by weight or less, preferably, from 2 to 40% by weight, the resultant phosphate film layer consists mainly of phosphophillite, ($Zn_2Fe(PO_4)_2.4H_2O$), in the form of fine particle-shaped dense crystals. With an increase in the content of zinc over 40% by weight, the content of hopeite ($Zn_3(PO_4)_2.4H_2O$) in the phosphate film layer increases. That is, when the content of zinc is in a range of from about 40 to about 60% by weight, the phosphate film layer consists of a mixture of the fine particle-shaped phosphophillite crystals and the hopeite crystals which are in the form of coarse needles. Also, when the content of zinc exceeds about 60% by weight, the phosphate film layer consists mainly of the hopeite crystals. Furthermore, when the content of zinc in the iron-zinc alloy coating layer is zero or very close to zero, the formation of the phosphate film layer becomes difficult and the covering percentage of the phosphate film layer on the iron-zinc alloy coating layer becomes poor. This phenomenon is indicated in FIG. 2, also. That is, when the content of zinc is close to zero or is zero, the resistance of the lacquer coating layer to the salt solution becomes poor.

As stated above, in the two layer-coated steel material, it is essential that a surface coating layer comprising an iron-zinc alloy containing 40% by weight or less, preferably, 2 to 40% by weight, of zinc, is formed on a base coating layer which has been formed on a surface of a steel substrate and which comprises zinc or a zinc-based alloy.

The content of zinc in the surface coating layer may be very small. However, it is preferable that the surface coating layer contains a certain amount of zinc because when a phosphate treatment is applied to the surface coating layer, zinc in the surface coating layer serves as the nucleuses of crystallization for the phosphate.

The amount of the surface coating layer is not limited to a specific range as long as the surface coating layer completely covers the surface of the base coating layer. However, when the phosphate treatment is applied to the surface coating layer, a portion of the surface coating layer is dissolved away. Also, when the cationic electrodeposition lacquer coating procedure is applied to the surface coating layer, a portion thereof is also dissolved away. Therefore, in order to maintain the base coating layer completely coated with the surface coating layer, it is preferable that the surface coating layer has a thickness of 0.01 micron or more, more preferably, 0.1 micron or more, still more preferably, 0.1 to 2 microns, and a weight of from 0.6 to 15 $g/m^2$.

The specific surface coating layer of the present invention is effective for promoting the formation of fine particle-shaped phosphophillite crystals which are effective for enhancing the bonding strength of the lacquer layer to the steel material. Therefore, the specific surface coating layer of the present invention is highly adequate for the phosphate treatment and the cationic electrodeposition lacquer coating procedure. The resultant phosphate-lacquer layer coated steel material exhibits an excellent resistance to corrosion and rusting, and has satisfactorily a small number of defects, that is, protuberances and pin holes.

The specific base coating layer of the present invention is effective for preventing electrochemical corrosion of the steel substrate.

The effects of the present invention, for example, on motor vehicles will be described below. When a steel material, for example, a cold rolled strip or a one surface-galvanized steel strip is used for forming the outside post of a motor vehicle, the non-galvanized surface of the steel strip exhibits a poor resistance to cosmetic corrosion. The zinc-plated (galvanized) surface of the steel strip exhibits a satisfactory resistance to cosmetic corrosion. However, as stated hereinabove, the zinc-plated surface causes the undesirable formation of defects such as protuberances and pin holes on and/or in the resultant lacquer coating layer.

However, when the two layer-coated steel material of the present invention is used for producing the outside parts of the motor vehicles, the cationic electrodeposition lacquer coating procedure can be applied thereto while preventing the occurrence of undesirable cratering defects. Also, the two layer-coated steel strip of the present invention is effective for enhancing the bonding strength of the lacquer coating layer to the steel substrate to an extent that even when a stone hits the surface of the lacquer coating layer while the motor vehicle is in motion, no separation of the lacquer coating layer from the motor vehicle occurs. Also, even if the lacquer coating layer is scratched, the steel substrate can be protected from corrosion and rusting by the base coating layer.

In the case where a steel material is used for producing a part located inside of motor vehicles, it is most important that the steel material is resistive to piercing corrosion. The two layer-coated steel material of the present invention exhibits not only the function of enhancing the resistance of the lacquer coating layer to corrosion by the function of the surface coating layer but also the function of electrochemically preventing piercing corrosion of the steel substrate by the function of the base coating layer.

The base coating layer in the two layer-coated steel material of the present invention will be further described below.

Generally, it is known that the conventional zinc coating layer exhibits a poor anti-creeping property. Even in the case of the two layer-coated steel material of the present invention, when the surface of the lacquer-coated steel material is scratched to an extent that the scratch reaches the surface of the steel substrate, and the scratched steel material is placed in a corrosive environment, the exposed zinc layer surface serves as an anode and is dissolved in the corrosive liquid while causing the surrounding portion of the dissolved portion of the zinc layer to become alkaline. This phenomenon causes the undesirable formation of blisters or creep on the lacquer coating layer. In order to prevent the above-mentioned disadvantages, it is necessary that the conventional surface coating layer has a large thickness.

The base coating layer can be produced by applying a conventional hot galvanizing or electroplating procedure to a steel substrate.

For example, when the base coating layer is produced by the galvanizing procedure, a heat treatment at a temperature of 250° to 600° C. may be applied to the zinc- or zinc-based alloy-coated steel material so as to allow a portion of iron in the steel substrate to diffuse into the galvanized base coating layer, before the surface coating layer-forming procedure. This procedure is effective for providing a zinc-iron alloy base coating layer having no $\eta$ phase. This type of base coating layer can exhibit an excellent anti-creeping property and a superior resistance to corrosion under a conventional anion electrodeposition lacquer coating layer. However, the anti-creeping property of the zinc-iron alloy coating layer is unsatisfactory under the cationic electrodeposition lacquer coating layer. This is because when a scratch reaches the steel substrate, the exposed surface portion of the zinc-iron alloy coating layer is anodically dissolved, but the surrounding portion of the dissolved portion does not become alkaline.

In the case of the two layer-coated steel material of the present invention, the zinc-iron alloy base coating layer prepared by the above-mentioned method, can exhibit an excellent resistance to corrosion even under the cationic electrodeposition lacquer coating layer. Therefore, it is not necessary for the thickness of the surface coating layer to be very large.

The specific base coating layer of the present invention can be prepared by any conventional methods including a galvanizing method or an electroplating method and can exhibit the above-mentioned specific functions thereof as long as the layer contains no $\eta$ phase therein.

The specific base coating layer of the present invention may contain one or more optional elements, for example, Ni, Co, Mo, Al, Cr, Mn, V, Sn, Cd, in addition to zinc or zinc and iron, unless the optional elements affect the electrochemical protecting effect of the specific base coating layer of the present invention.

When the specific base coating layer of the present invention consists mainly of an iron-zinc alloy, it is preferable that the zinc-iron alloy coating layer contains 40 to 93% by weight of zinc and has no $\eta$ phase. When the content of zinc is less than 40% by weight, sometimes, the galvanic protection effect of the base coating layer is unsatisfactory and, therefore, the resultant steel material exhibits an unsatisfactory resistance to rusting. When the content of zinc exceeds 93% by weight, usually, the resultant base coating layer contains a certain amount of $\eta$ phase.

The base coating layer of the present invention preferably has a weight of from 10 to 150 g/m$^2$ and a thickness of from 1.5 to 25 microns.

In the steel material of the present invention, only one surface of the steel substrate may be coated in accordance with the present invention and the other surface may not be coated or may be coated in a manner other than that of the present invention.

Also, only one surface of the steel substrate may be coated in accordance with the present invention, and the other surface may be coated with the specific base coating layer of the present invention alone. Furthermore, both surfaces of the steel substrate may be coated in accordance with the present invention. In this case, the two layers on one surface of the steel substrate may be the same as or different from those on the other surface of the steel substrate.

For example, a steel material is used for forming an outside panel of a motor vehicle, it is necessary that the outside surface of the panel exhibits an excellent resistance to rusting and the inside surface of the panel exhibits a superior resistance to piercing corrosion. For the purposes of attaining the above-mentioned requirements, it is preferable that the outside surface of the steel substrate is coated with a thin base coating layer comprising an alloy consisting of 10% by weight of iron and the balance zinc and, then, with a surface coating layer comprising an alloy consisting of 80% by weight of iron and the balance zinc, and the inside surface of the steel substrate may be coated with a thick base coating layer comprising zinc alone and, then, with a surface coating layer comprising an alloy consisting of 80% by weight of iron and the balance zinc.

The two layer-coated steel material of the present invention can be produced by the process of the present invention, which comprises the steps of:

forming a base coating layer comprising zinc or a zinc-based alloy on a surface of a steel substrate by means of a hot galvanizing procedure or an electroplating procedure and, then;

forming a surface coating layer comprising an iron-zinc alloy having a content of zinc of 40% by weight or less, on the base coating layer, by means of an electroplating procedure or a vacuum evaporation procedure.

The base coating layer may be formed by a conventional electroplating method or metal spraying method.

Before the base coating layer is formed, usually, the surface of the steel substrate is made clean as follows.

When the base coating layer is formed by a galvanizing method, the steel substrate is degreased by heating it in an oxidation furnace or a non-oxidation furnace and, then, the resultant oxide film formed on the surface of the steel substrate is eliminated by heat treating the steel substrate in a reducing atmosphere. The steel substrate having the cleaned surface is subjected to the galvanizing process. Otherwise, the steel substrate is degreased, pickled, flux-treated and, then, galvanized.

In the case where the base coating layer is formed by an electroplating method, the substrate consisting of a cold rolled steel strip is degreased and, then, pickled just before the electroplating process. When the substrate consists of a hot rolled steel strip, the substrate is preliminarily descaled and thereafter, degreased and pickled.

When the base coating layer is produced by the galvanizing method, it is easy to obtain a large thickness of the base coating layer. Therefore, this method is suitable for producing the steel material which is necessary to have an excellent resistance to heavy corrosion. In this galvanizing procedure, the coating metal may consist of zinc alone or a zinc-based alloy containing one or more alloying elements such as Al, Mg, Mn and Cu.

After the galvanizing procedure is applied to the steel substrate to form the base coating layer, a heat treatment may be applied to the galvanized steel substrate at a temperature of 250° to 600° C. for 5 seconds to 20 hours. This heat treatment is effective for allowing a portion of iron in the steel substrate to diffuse into the base coating layer. This technique is so-called galvann-heal-coating. This type of base coating layer exhibits a very excellent resistance to corrosion including corrosion under lacquer coating layer. This type of technique is easy to prepare a base coating layer containing 93% by weight or less of zinc and consisting mainly of $\delta_1$ phase and a small amount of $\zeta$ phase and $\rho$ phase and no $\eta$ phase. The base coating layer prepared by this type of technique may contain Al and optionally, Mg, Mn and/or Cu, in addition to zinc and iron.

The base coating layer may be formed by a conventional metal spraying method by using zinc or a zinc-based alloy containing Al, Mg, Mn and/or Cu. In this case, the heat treatment as stated above may be applied to the resultant base coating layer.

Also, the base coating layer can be produced by electroplating zinc or a zinc-based alloy containing, for example, Ni, Co, Mo, and/or Cr, on the surface of the steel substrate. In this case, the method as disclosed in British Pat. No. 786,418 can be utilized in which an electroplating liquid containing iron and zinc sulfate and a small amount of citric acid, is used. The concentration of iron ions and zinc ions can be changed to desired values. However, this method sometimes results in a base coating layer containing $\eta$ phase, in addition to $\delta$ phase and $\epsilon$ phase. Especially, an increase in the content of zinc results in an increase in the amount of $\eta$ phase. When the content of zinc is 60% by weight or more, it is unavoidable that the resultant base coating layer contain a certain amount of $\eta$ phase.

Generally, in order to enhance the anti-creeping property it is preferable that the base coating layer contains no $\eta$ phase. In order to produce the base coating layer containing no $\eta$ phase, by the electroplating method, it is preferable to use an electroplating liquid containing 10 g/l or more of citric acid in addition to iron and zinc sulfates and having a pH of 2.4 to 4.0 adjusted by, if necessary, adding an electrolyte to the electroplating liquid. The proportion in weight of zinc to iron in the resultant base coating layer can be adjusted to a desired value by controlling the proportion in concentration of zinc sulfate to iron sulfate in the electroplating liquid. The base coating layer produced by the electroplating method consists mainly of $\epsilon$ phase and may contain a small amount of $\delta$ and $\zeta$ phases.

If the concentration of citric acid in the electroplating liquid is smaller than 10 g/l, and/or if the pH of the electroplating liquid is below 2.4, sometimes, a certain amount of $\eta$ phase may be precipitated in the resultant base coating layer.

During the electroplating procedure, it is possible to maintain the concentrations of iron and zinc ions in the electroplating liquid constant by adding metallic iron and zinc therein.

In the electroplating system, due to the presence of 10 g/l of citric acid and to the pH adjusted to 2.4 or more, the oxidation rate of $Fe^{+2}$ into $Fe^{+3}$ is reduced on the anode, and the metallic iron and zinc are electrodeposited on the cathode. The deposited amounts of iron and zinc can be compensated for by adding metallic iron and zinc into the electroplating liquid. When the metallic iron and zinc are dissolved into the electroplating liquid, $Fe^{+3}$ ions in the electroplating liquid are reduced into $Fe^{+2}$ by the dissolved iron and zinc.

$$\text{Metallic Fe} + 2Fe^{+3} \rightarrow 3Fe^{+2}$$

$$\text{Metallic Zn} + 2Fe^{+3} \rightarrow Zn^{+2} + 2Fe^{+2}$$

Therefore, the amount of $F^{+3}$ can be maintained at a desirable low level. This effect is due to the large amount of citric acid of 10 g/l or more and the pH of 2.4 to 4.0. When the pH exceeds 4.0, the dissolving rates of zinc and iron into the electroplating liquid is significantly reduced so that it becomes difficult to maintain the concentration of iron and zinc ions at desired levels, respectively. Generally, when a soluble anode is used, the oxidation of $Fe^{+2}$ into $Fe^{+3}$ is small. Therefore, even in the case of the electroplating liquid of the above-mentioned British patent, it is possible to maintain the concentration of $Fe^{+3}$ at a low level. When an insoluble anode is used, the oxidation of $Fe^{+2}$ into $Fe^{+3}$ is vigorous, and, therefore, it is difficult to maintain the concentration of $Fe^{+3}$ at the low level. However, as long as the concentration of citric acid is maintained at the level of 10 g/l or more and the pH of the electroplating liquid is controlled to a range of 2.4 to 4.0, the concentration of $Fe^{+3}$ can be controlled to a desired low level even when an insoluble anode, for example, an anode consisting of Pb-4%Sn alloy or Pt, is used. This feature allows the elecroplating procedure to be carried out at a high current density, at a high passing speed of the steel substrate to be plated. That is, the above-mentioned type of electroplating method is suitable for mass production of the base coated steel material at a low cost. Also, by reducing the concentration of $Fe^{+3}$, the undesirable reduction of cathode efficiency can be avoided. This is an important advantage of the above-mentioned type of electroplating method.

The thickness of the surface coating layer may be small as long as the objects of the present invention can be attained. Therefore, the surface coating layer can be prepared by a conventional electroplating method or vacuum evaporation method.

When the surface coating layer is prepared by the electroplating method, the method disclosed in British Pat. No. 786,418 can be utilized. In this British patent method, a soluble anode and an electroplating liquid containing, for example, 248 g/l of $FeSO_4.7H_2O$, 20 g/l of $ZnSO_4.7H_2O$, 10 g/l of KCl, 118 g/l of $(NH_4)_2SO_4$ and 0.5 g/l of citric acid, are used. A surface coating layer consisting of 9% by weight of zinc and the balance consisting of iron is obtained. The proportion in weight of zinc to iron in the surface coating layer can be adjusted to a desired value by controlling the proportion in the concentration of zinc sulfate to iron sulfate in the electroplating liquid.

Preferably, the surface coating layer can be produced by using an electroplating liquid containing the desired amounts of zinc sulfate and iron sulfate and 10 g/l or more of citric acid and having a pH of 2.4 to 4.0. The specific advantages of this method has been described in detail hereinbefore.

When the electroplating procedure for producing the surface coating layer is applied to the base coating layer which has been produced by the galvanizing or metal spraying procedure, it is preferable that before applying the electroplating procedure, the surface of the base coating layer is lightly degreased and/or pickled. Also, after the surface coating layer is formed on the base coating layer, the afore-mentioned heat treatment may be applied to the resultant two layer-coated steel material, at a temperature of 200° to 300° C. for 5 to 20 minutes, so as to eliminate strains retained in the structure of the electroplated surface coating layer, to control the form of crystals and to enhance the bonding property of the surface coating layer to the steel substrate.

When the base coating layer is produced by the electroplating method, the surface of the resultant base coating layer is rinsed with water and, then, subjected to the next electroplating procedure for producing the surface coating layer. The electroplating liquid used for producing the base coating layer can be used for producing the surface coating layer by changing the concentrations of iron sulfate and zinc sulfate therein. In this case, the water-rinsing procedure for the base coating layer can be omitted.

The present invention will be further illustrated by the following examples.

In each of the examples, the following tests were applied to the product of the example.

1. Content of phosphophillite in phosphate film layer

A phosphate film layer which has been prepared by a dipping type zinc-iron phosphate treatment on the product of the example, was subjected to an X-ray diffraction analysis. The intensities of the peaks corresponding to phosphophillite and hopeite were measured. The content of phosphophillite was determined in accordance with the following equation:

$$\text{Content of phosphophillite (\%)} = \frac{\text{Intensity of phosphophillite peaks}}{(\text{Intensity of phosphophillite peaks} + \text{intensity of hopeite peaks})} \times 100$$

2. The number of defects in and/or on the cationic electrodeposition lacquer coating layer A lacquer coating layer was formed on the product of the example by a cationic electrodeposition method at a voltage of 280 V, at a temperature of the electrodeposition liquid of 28° C., at a ratio in area of the surface of the specimen to be coated, to the surface of the electrode, of 1/10, for 2 minutes. The surface area of the specimen was 90 $cm^2$. The number of the defects (protuberances and pin holes) on and/or in the resultant lacquer coating layer was counted. The lacquer coating layer having 20 defects or less per 90 $cm^2$ of the surface area thereof is regarded as satisfactory.

3. Bonding property of lacquer coating layer to the product of the example

A lacquer coating layer having a thickness of 80 microns was formed on a surface of the product of the example which had been treated with a zinc-iron phosphate solution, by applying a cationic electrodeposition undercoating procedure, and an intermediate coating procedure and an uppercoating procedure by a conventional spraying method. The lacquer coated steel material was immersed in water at a temperature of 40° C. for 240 hours, withdrawn from water and, immediately subjected to an evaluation test in which on the lacquer coating layer, eleven vertical scratches and eleven lateral scratches are formed at intervals of 2 mm so as to reach the surface of the steel substrate and to form 100 squares separated from each other by the scratches. An adhesive tape was adhered to the surface of the scratched coating layer and peeled off. The number of squares of the lacquer coating layer separated from the steel substrate was counted. The intensity of bounding property of the lacquer coating layer was represented by the number of the separated squares.

4. Resistance of lacquer coating layer to corrosion

A cationic electrodeposition lacquer coating layer having a thickness of 20 microns was formed on the product of the example which had been treated with an iron-zinc phosphate solution. The lacquer coating layer was subjected to a cross-cutting in which the cross-scratches reached the surface of the steel substrate. The cross-cut lacquer coating layer was subjected to a salt solution-spraying test for 840 hours. Thereafter, an adhesive tape was adhered to the surface of the cross-cut lacquer coating layer and peeled. The largest width of pieces of the lacquer coating layer separated from the steel substrate was measured. The width of each separated piece was measured from the corresponding cut line.

EXAMPLE 1

A surface of a steel strip was made clean by using a non-oxidation furnace and a reducing furnace and subjected to a conventional continuous glavanizing procedure using a galvanizing zinc bath containing 0.16% by weight of Al. A resultant base coating layer had a composition and weight as indicated in Table 1. The surface of the base coating layer was degreased by an alkali aqueous solution, lightly pickled and, then, subjected to an electroplating procedure by using an electroplating liquid having the following composition, at a temperature of 50° C., at a current density of 30 $A/dm^2$.

COMPOSITION $FeSO_4.7H_2O$: 250 g/l
$ZnSO_4.7H_2O$: 80 g/l
$(NH_4)_2SO_4$: 120 g/l
KCl: 10 g/l
Citric acid: 0.5 g/l The resultant surface coating layer had a composition and a weight as indicated in Table 1.

The resultant two layer-coated steel strip was subjected to the afore-mentioned tests. The results are indicated in Table 2.

EXAMPLE 2

The same procedures as those described in Example 1 were carried out, except that after the continuous galvanizing procedure was completed, the resultant base-coated steel strip was heat treated at a temperature of 550° C. for 9 seconds, the resultant heat treated base coating layer had a composition and a weight as indicated in Table 1, and the electroplating procedure for producing the surface coating layer was carried out at a temperature of 45° C., at a current density of 80 $A/dm^2$ by using an electroplating liquid having the following composition and a pH of 3.3 while flowing it at a speed of 20 m/min.

COMPOSITION $FeSO_4.7H_2O$: 100 g/l
$ZnSO_4.7H_2O$: 20 g/l
$(NH_4)_2SO_4$: 20 g/l
$K_2SO_4$: 20 g/l
Ammonium citrate: 60 g/l The resultant surface coating layer had a composition and weight as indicated in Table 1.

The result of the tests are indicated in Table 2.

EXAMPLE 3

The same procedures as those described in Example 2 were carried out except for the following items.

(1) The galvanizing zinc both contained 0.16% by weight of Al and 0.4% by weight of Mg as an additional element.

(2) The resultant base coating layer had a composition and a weight as indicated in Table 1.

(3) The electroplating liquid for producing the surface coating layer had a pH of 3.5 and the following composition.

$FeSO_4.7H_2O$: 100 g/l
$ZnSO_4.7H_2O$: 8 g/l
$(NH_4)_2SO_4$: 20 g/l
KCl: 20 g/l
Ammonium citrate: 60 g/l (4) The resultant surface coating layer had a weight and a composition as indicated in Table 1.

The results of the tests are indicated in Table 2.

EXAMPLE 4

The same procedures as those described in Example 1 were carried out except for the following items.

(1) The base coating layer comprising zinc alone and having a weight of 20 g/m$^2$ was produced by a conventional electroplating procedure.

(2) The surface coating layer was produced by using the same electroplating procedure as that described in Example 3, except that the electroplating liquid contained $FeSO_4.7H_2O$: 100 g/l
$ZnSO_4.7H_2O$: 20 g/l
$(NH_4)_2SO_4$: 20 g/l
$K_2SO_4$: 20 g/l and
Ammonium citrate: 60 g/l and had a temperature of 45° C. and a pH of 3.0, the current density was 60 A/dm$^2$ and the flow speed of the electroplating liquid was 20 m/min.

(3) The resultant coating layer had a composition and weight as indicated in Table 1.

EXAMPLE 5

The same procedures as those mentioned in Example 4 were carried out, except for the following items.

(1) The base coating layer having the composition and weight as indicated in Table 1 were produced by using an electroplating liquid containing:

$ZnSO_4.7H_2O$: 180 g/l
$NiSO_4.6h_2O$: 230 g/l
$(NH_4)_2SO_4$: 20 g/l and
$Na_2SO_4$: 100 g/l at a temperature of 60° C. at a pH of 1.8 which was adjusted by using $H_2SO_4$, at a current density of 40 A/dm$^2$.

(2) The surface coating layer having the composition and weight as indicated in Table 1 was produced by using an electroplating liquid containing:

$FeSO_4.7H_2O$: 100 g/l
$ZnSO_4.7H_2O$: 40 g/l
$NiSO_4.6H_2O$: 5 g/l
$(NH_4)_2SO_4$: 20 g/l
$K_2SO_4$: 20 g/l
Ammonium citrate: 50 g/l at a temperature of 45° C. at a pH of 3.0 at a current density of 50 A/dm$^2$ at a flow speed of 20 m/min.

EXAMPLE 6

The same procedures as those described in Example 4 were carried out, except for the following items.

(1) The base coating layer having the composition and weight as indicated in Table 1 was produced by using an electroplating liquid containing:

$FeSO_4.7H_2O$: 100 g/l
$ZnSO_4.7H_2O$: 120 g/l
$(NH_4)_2SO_4$: 20 g/l
$K_2SO_4$: 20 g/l
Ammonium citrate: 60 g/l at a temperature of 51° C. at a pH of 3.2 at a current density of 160 A/dm$^2$ at a flow speed of 150 m/min.

(2) The surface coating layer having the composition and weight as indicated in Table 1 was produced by using an electroplating liquid containing:

$FeSO_4.7H_2O$: 100 g/l
$ZnSO_4.7H_2O$: 20 g/l P1 $(NH_4)_2SO_4$: 20 g/l
$K_2SO_4$: 20 g/l
Ammonium citrate: 60 g/l at a temperature of 45° C. at a pH of 3.5 at a current density of 120 A/dm$^2$ at a flow speed of 150 m/min.

EXAMPLE 7

The same procedures as those described in Example 4 were carried out, except for the following items.

(1) The base coating layer having the composition and weight as indicated in Table 1 was produced by using an electroplating liquid containing:

$FeSO_4.7H_2O$: 180 g/l
$ZnSO_4.7H_2O$: 220 g/l
$(NH_4)_2SO_4$: 20 g/l
KCl: 20 g/l
Ammonium citrate: 140 g/l at a temperature of 50° C. at a pH of 3.3 at a current density of 80 A/dm$^2$ at a flow speed of 140 m/min.

(2) The surface coating layer having the composition and weight as indicated in Table 1 was produced by using an electroplating liquid containing:

$FeSO_4.7H_2O$: 100 g/l
$ZnSO_4.7H_2O$: 13 g/l
$(NH_4)_2SO_4$: 20 g/l
$K_2SO_4$: 20 g/l
Ammonium citrate: 30 g/l at a temperature of 45° C. at a pH of 3.0 at a current density of 60 A/dm$^2$ at a flow speed of 20 m/min.

EXAMPLE 8

The same procedures as those described in Example 4 were carried out except for the following items.

(1) The base coating layer having the composition and weight as indicated in Table 1 was produced by using an electroplating liquid comprising:

$FeSO_4.7H_2O$: 75 g/l
$ZnSO_4.7H_2O$: 150 g/l
$(NH_4)_2SO_4$: 20 g/l
$K_2SO_4$: 20 g/l
Ammonium citrate: 60 g/l at a temperature of 50° C. at a pH of 2.5, which was adjusted by using $H_2SO_4$, at a current density of 120 A/dm$^2$ at a flow speed of 50 m/min. After the electroplating procedure was started, a portion of $Fe^{+2}$ ions was oxidized so that 4 g/l of $Fe^{+3}$ ions were contained in the electroplating liquid.

(2) The surface coating layer having the composition and weight as indicated in Table 1 was produced by using an electroplating liquid containing:

$FeSO_4.7H_2O$: 100 g/l
$ZnSO_4.7H_2O$: 5 g/l
$(NH_4)_2SO_4$: 20 g/l
$K_2SO_4$: 20 g/l
Ammonium citrate: 20 g/l at a temperature of 45° C. at a pH of 2.7, which was adjusted by using $H_2SO_4$, at a current density of 80 A/dm$^2$ at a flow speed of 20 m/min.

EXAMPLE 9

Procedures identical to those described in Example 4 were carried out with the following exception.

(1) The base coating layer having the composition and weight as indicated in Table 1 was produced by using an electroplating liquid containing:

$FeSO_4.7H_2O$: 100 g/l
$ZnSO_4.7H_2O$: 60 g/l
$(NH_4)_2SO_4$: 20 g/l
$K_2SO_4$: 20 g/l
Ammonium citrate: 20 g/l at a temperature of 53° C. at a pH of 2.9, which was adjusted by using $H_2SO_4$, at a current density of 100 A/dm$^2$ at a flow speed of 20 m/min.

(2) The surface coating layer having the composition and weight as indicated in Table 1 was produced by using an electroplating liquid containing:

$FeSO_4.7H_2O$: 250 g/l
$ZnSO_4.7H_2O$: 4 g/l
$(NH_4)_2SO_4$: 120 g/l
Citric acid: 0.5 g/l at a temperature of 50° C. at a pH of 2.5, which was controlled by using $H_2SO_4$, at a current density of 30 A/dm$^2$.

COMPARISON EXAMPLE 1

The same procedures as those described in Example 1 were carried out, except that no surface coating layer was produced.

COMPARISON EXAMPLE 2

The same procedures as those described in Example 2 were carried out, except that no surface coating layer was produced.

COMPARISON EXAMPLE 3

The same procedures as those mentioned in Example 6 were carried out, except that no surface coating layer was produced.

TABLE 1

| | Base coating layer | | | | | | Surface coating layer | | | | |
|---|---|---|---|---|---|---|---|---|---|---|---|
| | Producing method | Composition (% by weight) Al | Fe | Ni | Zn | Weight (g/m$^2$) | Producing method | Composition (% by weight) Fe | Zn | Ni | Weight (g/m$^2$) |
| Example No. | | | | | | | | | | | |
| 1 | Galvanizing | 0.25 | 0.9 | — | Balance | 90 | Electroplating | 65 | 35 | — | 10 |
| 2 | Galvanizing and heat treatment | 0.12 | 10 | — | " | 45 | " | 75 | 25 | — | 5 |
| 3 | Galvanizing and heat treatment | 0.1 | 8 | Mg 0.4 | " | 30 | " | 90 | 10 | — | 2 |
| 4 | Electroplating | — | — | — | 100 | 20 | " | 80 | 20 | — | 5 |
| 5 | " | — | — | 13 | 87 | 15 | " | 59 | 38 | 3 | 3 |
| 6 | " | — | 30 | — | 70 | 20 | " | 80 | 20 | — | 3 |
| 7 | " | — | 30 | — | 70 | 20 | " | 85 | 15 | — | 2 |
| 8 | " | — | 20 | — | 80 | 20 | " | 95 | 5 | — | 1.5 |
| " | " | — | 50 | — | 50 | 30 | " | 98 | 2 | — | 0.8 |
| Comparison Example No. | | | | | | | | | | | |
| 1 | Galvanizing | 0.25 | 0.9 | — | Balance | 90 | — | — | — | — | — |
| 2 | Galvanizing and heat treatment | 0.12 | 10 | — | " | 45 | — | — | — | — | — |
| 3 | Electroplating | — | 30 | — | 70 | 20 | — | — | — | — | — |

TABLE 2

| | Content of phosphophillite in phosphate film layer (%) | The number of defects in and/or on cation electro-deposition lacquer coating layer per 90 cm$^2$ | Resistance of lacquer coating layer to water (the number of separated squares) | Resistance of lacquer coating layer to corrosion (The largest width of blisters (mm)) |
|---|---|---|---|---|
| Example No. | | | | |
| 1 | 100 | 15 | 0 | 4 |
| 2 | 100 | 5 | 0 | 2 |
| 3 | 100 | 10 | 0 | 2 |
| 4 | 100 | 12 | 0 | 4 |
| 5 | 100 | 12 | 0 | 2 |
| 6 | 100 | 5 | 0 | 2 |
| 7 | 100 | 10 | 0 | 5 |
| 8 | 100 | 10 | 0 | 3 |
| 9 | 100 | 12 | 0 | 3 |
| Comparison Example No. | | | | |
| 1 | 0 | 80 | 100 | >10 |
| 2 | 0 | >100 | 30 | 7 |
| 3 | 0 | >100 | 80 | >10 |

We claim:

1. A two layer-coated steel material especially suitable for the cationic electrodeposition of a lacquer coating thereon which lacquer coating has few surface defects and excellent corrosion-resistant properties, said two-layer steel material comprising a steel substrate and a two layer-coating composed of (1) a base coating layer formed on a surface of said steel substrate, which base coating layer is zinc or a zinc-based alloy, said base coating capable of protecting the steel substrate from corrosion and (2) a surface coating layer formed on said base coating layer, which surface coating layer is an iron-zinc alloy having an effective amount of zinc up to 40% by weight sufficient to reduce the surface defects and enhance the corrosion resistance of said two layer coated material.

2. A two layer-coated steel material as claimed in claim 1, wherein said base coating layer has a weight of 10 to 150 g/m$^2$.

3. A two layer-coated steel material as claimed in claim 1, wherein said surface coating layer has a weight of 0.6 to 15 g/m$^2$.

4. A two layer-coated steel material as claimed in claim 1, wherein said base coating layer comprises an iron-zinc alloy containing 40 to 93% by weight of zinc and having no $\eta$ phase.

5. A two layer coated steel material as claimed in claim 1, wherein the content of zinc in said surface coating layer is in the range of from 2 to 40% by weight.

6. A two-layer-coated steel material as claimed in claim 1, wherein said surface coating layer has a thickness of 0.01 micron or more.

* * * * *